US010233626B2

(12) United States Patent
Otowa et al.

(10) Patent No.: US 10,233,626 B2
(45) Date of Patent: Mar. 19, 2019

(54) SANITARY WASHING APPARATUS

(71) Applicant: TOTO LTD., Fukuoka (JP)

(72) Inventors: Yuya Otowa, Kitakyushu (JP); Hiroshi Hashimoto, Kitakyushu (JP); Satoshi Kawada, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 107 days.

(21) Appl. No.: 14/881,705

(22) Filed: Oct. 13, 2015

(65) Prior Publication Data

US 2016/0108610 A1 Apr. 21, 2016

(30) Foreign Application Priority Data

Oct. 14, 2014 (JP) ..... 2014-209858
Jan. 29, 2015 (JP) ..... 2015-015796

(51) Int. Cl.
*E03D 9/08* (2006.01)
*A47K 13/24* (2006.01)

(52) U.S. Cl.
CPC ..... *E03D 9/08* (2013.01); *A47K 13/24* (2013.01)

(58) Field of Classification Search
CPC ..... A47K 3/26; E03D 9/08
USPC ..... 4/420.1–420.5, 444–448
See application file for complete search history.

(56) References Cited

U.S. PATENT DOCUMENTS 6,754,912 B1 * 6/2004 Hayashi ..... E03D 9/08 239/468
6,795,981 B2 * 9/2004 Sato ..... A61H 33/6047 4/420.4
8,272,077 B2 * 9/2012 Hashimoto ..... A47K 7/08 4/420.4
8,495,770 B2 * 7/2013 Koga ..... B05B 1/3426 4/420.4
8,701,222 B2 * 4/2014 Shin ..... E03D 9/08 4/420.4
9,074,361 B2 * 7/2015 Mochita ..... E03D 9/08
2011/0030133 A1 * 2/2011 Morotomi ..... E03D 9/08 4/443

FOREIGN PATENT DOCUMENTS

JP H11-350570 A 12/1999
JP 2001-090151 A 4/2001
JP 2001-311201 A 11/2001
JP 2005-76417 A 3/2005
JP 2010-222856 A 10/2010
JP 2012-127107 A 7/2012

* cited by examiner

*Primary Examiner* — Paul R Durand
*Assistant Examiner* — Nicholas A Ros
(74) *Attorney, Agent, or Firm* — Studebaker & Brackett PC

(57) ABSTRACT

When a water discharge start operation section is operated, a control unit executes, before executing a main washing mode in which wash water is discharged at a set flow rate selected in a water force selection operation section, a stored water generating mode in which required wash water is stored in a bubble mixture section by discharging wash water at a set flow rate smaller than the flow rate selected in the water force selection operation section.

4 Claims, 12 Drawing Sheets

FIG. 5A
FIG. 5B
FIG. 5C
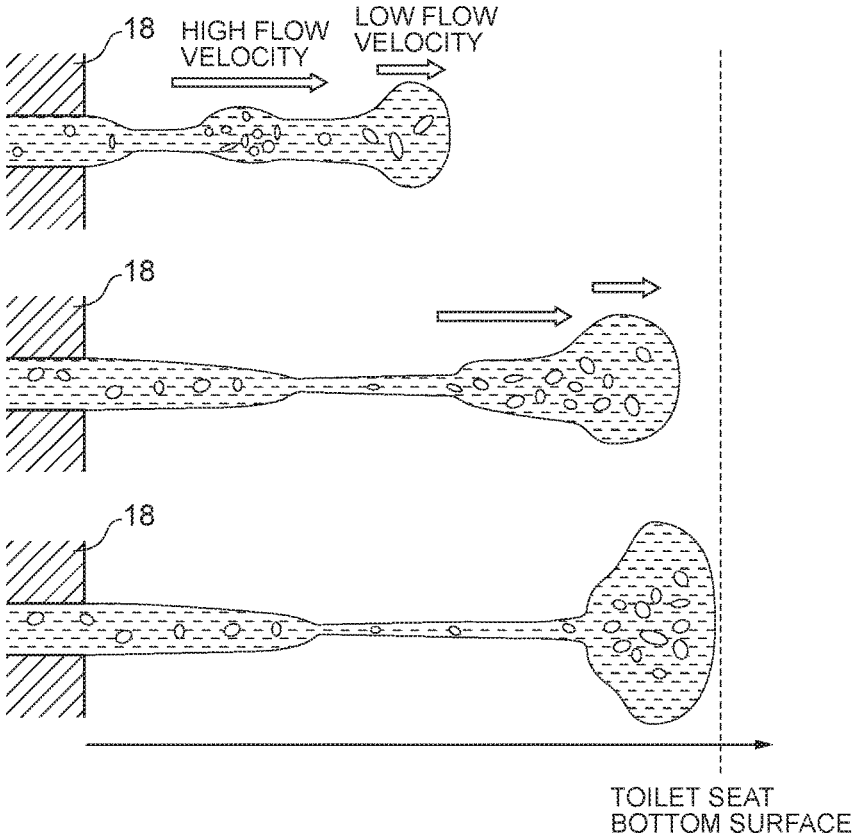
FIG. 6A
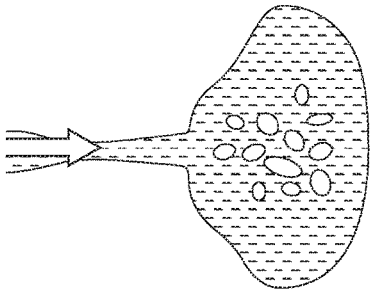
FIG. 6B
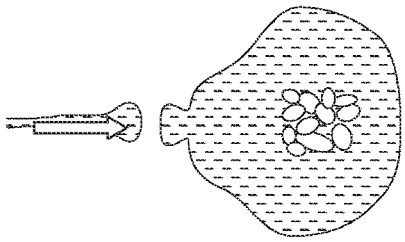

FIG.11

| WATER FORCE IN MAIN WASHING MODE | WATER FORCE IN STORED WATER GENERATING MODE |
|---|---|
| 5 | 3 |
| 4 | 2 |
| 3 | 1 |
| 2 | 1 |
| 1 | 1 |

SANITARY WASHING APPARATUS

BACKGROUND OF THE INVENTION

Field of the Invention

The present invention relates to a sanitary washing apparatus that discharges wash water toward a private part of a user.

Description of the Related Art

A sanitary washing apparatus described in Japanese Patent Laid-Open No. 2001-90151 supplies wash water to a water discharge hole in a state in which a pressure of the wash water pulsates. Accordingly, a flow rate and a flow velocity of the wash water similarly pulsate, and the wash water is discharged such that the flow rate and the flow velocity pulsate and vary between a state of a maximum flow rate and a maximum flow velocity and a state of a minimum flow rate and a minimum flow velocity. Respective discharged water portions have a water discharge form in a state in which a discharged water portion having a maximum flow rate and a maximum flow velocity coalesces with a preceding discharged water portion to form a mass of water, and the mass of water is linked by a discharged water portion discharged later. A washing feeling of the sanitary washing apparatus is identified by a feeling of massiveness and a feeling of stimulation. In order to form a larger mass of water in the sanitary washing apparatus described in Japanese Patent Laid-Open No. 2001-90151, a pulsation amplitude of the wash water pressure needs to be increased. However, if the pulsation amplitude of the wash water pressure is increased, the discharged water portion having a maximum flow rate and a maximum flow velocity breaks through the preceding discharged water portion, and the catch-up and coalescence phenomenon does not occur.

In a sanitary washing apparatus described in Japanese Patent Laid-Open No. 2012-127107, a larger mass of water is formed by mixing bubbles into discharged water in addition to the catch-up phenomenon obtained by the pulsation of the wash water pressure described above. When bubbles are mixed into the mass of water as described above, the feeling of massiveness is improved, while it is difficult to improve the feeling of stimulation since the mass of water is softened.

In the sanitary washing apparatus described in Japanese Patent Laid-Open No. 2012-127107, increasing the pulsation amplitude of the wash water pressure as described above is considered as a solution to improve the feeling of stimulation. However, as mentioned in the description of the sanitary washing apparatus in Japanese Patent Laid-Open No. 2001-90151, it has been considered that the discharged water portion having a maximum flow rate and a maximum flow velocity breaks through the preceding discharged water portion when the pulsation amplitude of the wash water pressure is increased, and the catch-up and coalescence phenomenon does not occur.

However, as a result of intensive study, the present inventors have obtained a novel finding that, when bubbles are mixed into the discharged water under a certain condition, surface energy of the water stream is increased, and thus, even when the pulsation amplitude of the wash water pressure is increased, the water stream does not burst when the catch-up phenomenon occurs. The surface energy of the water stream is proportional to a total area of a gas-liquid interface of the water stream (a sum of an external surface area of the water stream and an internal area of the water stream in contact with the bubbles). The present inventors consider that the water stream is less likely to be deformed when the surface energy is increased.

By the way, in a case in which air is mixed into the discharged water by an ejector effect in a high-pressure band in which the wash water pressure is increased, a large amount of bubbles having a relatively large size are introduced. The large amount of introduced bubbles coalesce with each other by a surface tension with an elapse of time and grow up into larger bubbles. Since the surface energy of the water stream is dependent on the internal area in contact with the bubbles contained therein as described above, the coalescence of the bubbles results in a decrease in the internal area, so that the surface energy is gradually decreased. Thus, there occurs a new problem that the water stream bursts before reaching a private part of a user.

Thus, the present inventors have moved forward with their study to provide a sanitary washing apparatus which can prevent a water stream from bursting before the water stream reaches a private part of a user even when air is mixed into discharged water to which pressure variation in a high-pressure band is given in order to achieve both of a high feeling of massiveness and a high feeling of stimulation.

In order to solve the new problem, the present inventors considered that suppressing an amount of bubbles contained in wash water by decreasing an amount of wash water temporarily stored in a bubble mixture section may be one of effective means. However, when the amount of wash water temporarily stored in the bubble mixture section is decreased, the small amount of stored water is pushed out by a force of a water stream breaking into the stored wash water. Thus, it becomes difficult for the wash water to accumulate.

The present invention has been made in view of the problems as described above, and an object thereof is to provide a sanitary washing apparatus which can prevent a water stream from bursting before the water stream reaches a private part of a user even when air is mixed into discharged water to which pressure variation in a high-pressure band is given in order to achieve both of a high feeling of massiveness and a high feeling of stimulation, the sanitary washing apparatus capable of decreasing an amount of water stored in a bubble mixture section, and retaining the stored water.

SUMMARY OF THE INVENTION

In order to achieve the above object, a sanitary washing apparatus according to the present invention is a sanitary washing apparatus that discharges wash water toward a private part of a user, the sanitary washing apparatus including: a toilet seat on which the user sits for excretion; a washing nozzle having a water discharge port that discharges the wash water toward the private part of the user sitting on the toilet seat; a pressure variation unit that gives pressure variation to the wash water to be supplied to the water discharge port; a bubble mixed water generation unit that is provided between the pressure variation unit and the water discharge port to mix bubbles into the wash water to which the pressure variation is given by the pressure variation unit; an operation unit having a water discharge start operation section that allows the user to instruct a water discharge start of the wash water, and a water force selection operation section that allows the user to select a set flow rate of the wash water; and a control unit that controls the sanitary washing apparatus according to an input to the operation unit. The pressure variation unit is configured to intermittently execute a pressure raising process in which a pressure of the wash water discharged from the water discharge port is continuously raised over a predetermined duration such that a mass of water formed with wash water discharged from the water discharge port later catching up with wash water discharged from the water discharge port first intermittently arrives at the private part of the user. The bubble mixed water generation unit includes: a squirting port that squirts the wash water to which the pressure variation is given by the pressure variation unit toward the water discharge port; an air introduction port that is provided between the squirting port and the water discharge port to introduce air by use of a negative pressure generated by the wash water squirted from the squirting port; and a bubble mixture section that is provided between the air introduction port and the water discharge port to temporarily store the wash water squirted from the squirting port and mix the air introduced from the air introduction port into the stored wash water in a form of a plurality of bubbles. When the water discharge start operation section is operated, the control unit executes, before executing a main washing mode in which wash water is discharged at a set flow rate selected in the water force selection operation section, a stored water generating mode in which required wash water is stored in the bubble mixture section by discharging wash water at a set flow rate smaller than the flow rate selected in the water force selection operation section.

In accordance with the present invention, since the pressure variation unit gives the pressure variation to the wash water to be supplied to the water discharge port, a catch-up phenomenon occurs by pulsation of the wash water pressure, and a larger mass of water can be formed and supplied to the private part of the user. Since the bubble mixed water generation unit mixes the air introduced from the air introduction port into the wash water in the form of the plurality of bubbles, a larger mass of water, a volume of which is increased by the bubbles, can be formed. Also, in the bubble mixed water generation unit, air is introduced by use of the negative pressure generated by the wash water squirted from the squirting port, the wash water squirted from the squirting port is temporarily stored, and the air introduced from the air introduction port is mixed into the stored wash water in the form of the plurality of bubbles. Thus, bubble mixed water can be generated without using an air pump or the like.

Also, since the stored water generating mode in which wash water is discharged at a flow rate smaller than a set flow rate selected by the user is provided before the main washing mode, a small amount of wash water can be stored in the bubble mixture section. Accordingly, an air mixture amount mixed into the wash water can be decreased. Thus, even when air is mixed into discharged water to which pressure variation in a high-pressure band is given, it is possible to suppress a burst of a water stream before the water stream reaches the private part of the user. Note that the amount of the wash water stored in the bubble mixture section in the stored water generating mode is set to a smallest possible amount within a range in which the stored wash water is not pushed outside all at once in the subsequent main washing mode (having a larger flow rate than that in the stored water generating mode).

In the sanitary washing apparatus according to the present invention, the control unit may preferably suppress operation of the pressure variation unit in the stored water generating mode to be lower than operation of the pressure variation unit in the main washing mode.

By suppressing the operation of the pressure variation unit in the stored water generating mode to be lower than the operation of the pressure variation unit in the main washing mode, it is possible to surely store a small amount of wash water in the bubble mixture section in the stored water generating mode.

In the sanitary washing apparatus according to the present invention, the control unit may be preferably configured to increase the flow rate of the wash water discharged in the stored water generating mode according to an increase in the flow rate selected in the water force selection operation section.

When the flow rate in the main washing mode is increased, a force for pushing out the stored wash water is also increased. In order to respond to the pushing force, the flow rate in the stored water generating mode is increased to increase the stored water according to the increase in the flow rate in the main washing mode such that the stored wash water is not pushed outside all at once by a squirting force.

In the sanitary washing apparatus according to the present invention, the control unit may preferably execute a gradual transition mode in which the flow rate is gradually made closer to the flow rate in the main washing mode from the flow rate in the stored water generating mode between the stored water generating mode and the main washing mode.

In the preferred aspect, by executing the gradual transition mode in which the flow rate is gradually made closer to the flow rate in the main washing mode from the flow rate in the stored water generating mode, the user feels less uncomfortable about a change in the flow rate from the stored water generating mode to the main washing mode.

In the sanitary washing apparatus according to the present invention, after the gradual transition mode is completed, the control unit may preferably start operating the pressure variation unit.

In the preferred aspect, the user feels less uncomfortable about a change in the flow rate from the stored water generating mode to the main washing mode.

BRIEF DESCRIPTION OF THE DRAWINGS

FIGS. 5A, 5B and 5C are views schematically illustrating states of the wash water discharged from the wash water supply unit (the nozzle);

FIG. 6A is a view schematically illustrating a state of the wash water discharged from the wash water supply unit (the nozzle);

FIG. 6B is a view schematically illustrating a state of the wash water discharged from the wash water supply unit (the nozzle);

FIG. 11 is a view illustrating a correspondence relationship between a main washing mode and a stored water generating mode;

DETAILED DESCRIPTION OF THE PREFERRED EMBODIMENT

Figure 1:
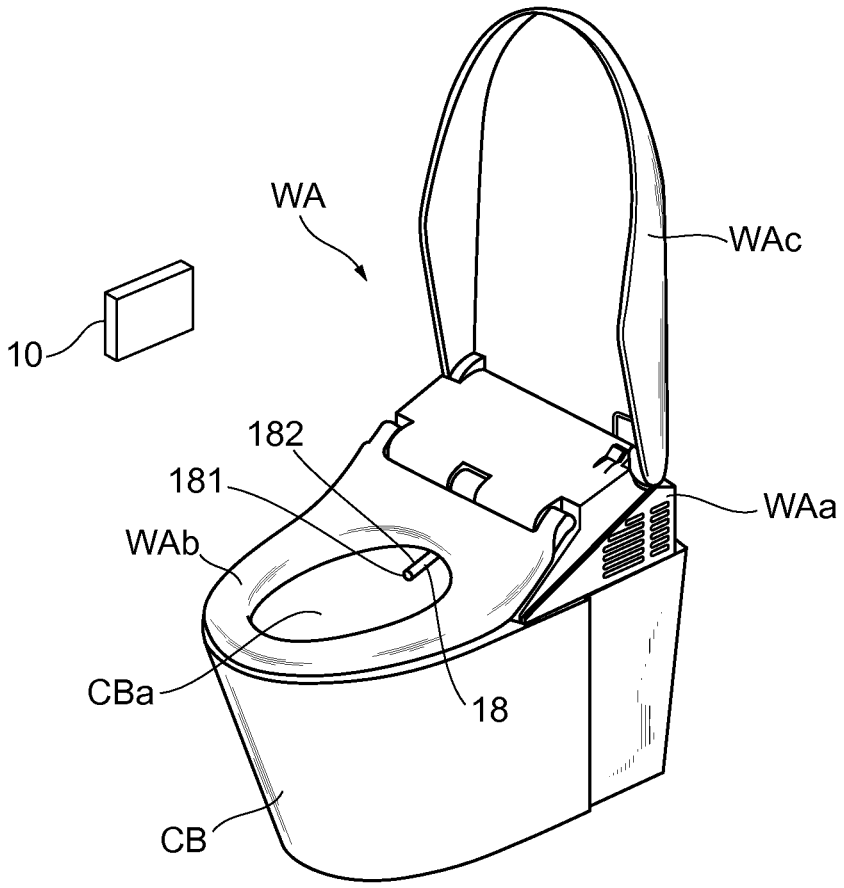
FIG. 1 is a perspective view illustrating a warm water washing toilet seat including a sanitary washing apparatus according to an embodiment of the present invention.

In the following, an embodiment of the present invention will be described by reference to the accompanying drawings. In order to facilitate understanding of description, the same constituent elements in the respective drawings are assigned the same reference numerals as much as possible, and overlapping description is omitted.

A warm water washing toilet seat including a sanitary washing apparatus according to the embodiment of the present invention will be described by reference to FIG. 1. FIG. 1 is a schematic perspective view illustrating the warm water washing toilet seat including the sanitary washing apparatus according to the embodiment of the present invention. As shown in FIG. 1, a warm water washing toilet seat WA (the sanitary washing apparatus) is placed on a closet bowl CB to be used. The warm water washing toilet seat WA includes a body WAa, a toilet seat WAb, a toilet cover WAc, and an operation unit 10. The operation unit 10 is provided with an operation panel, and transmits an operation signal according to an operation of the operation panel to the body WAa.

For example, when a portion of the operation panel displayed as a "large flush" or a "small flush" is operated, an operation signal indicative of execution of a flushing action corresponding to the "large flush" or the "small flush" is transmitted to the body WAa. When the operation signal is transmitted, the body WAa executes an action of flushing a bowl surface CBa of the closet bowl CB with wash water for washing the bowl surface CBa.

For example, when a portion of the operation panel displayed as a "bottom wash" or a "bidet wash" is operated, an operation signal indicative of discharge of wash water corresponding to the "bottom wash" or the "bidet wash" is transmitted to the body WAa. When the operation signal is transmitted, the body WAa executes an action of extending a nozzle 18 (including a wash water supply unit; also referred to as a wash water supply unit below) and discharging wash water.

The nozzle 18 is adapted to discharge wash water for washing an area around the anus, the vaginal opening, or the urethral opening of a user sitting on the toilet seat WAb. The nozzle 18 is provided with a bidet wash water discharge hole 181 (a water discharge hole) and a bottom wash water discharge hole 182 (a water discharge hole). When the user operates the portion of the operation panel displayed as the "bottom wash", the bottom wash water discharge hole 182 discharges wash water. Also, when the user operates the portion of the operation panel displayed as the "bidet wash", the bidet wash water discharge hole 181 discharges wash water.

Figure 2:
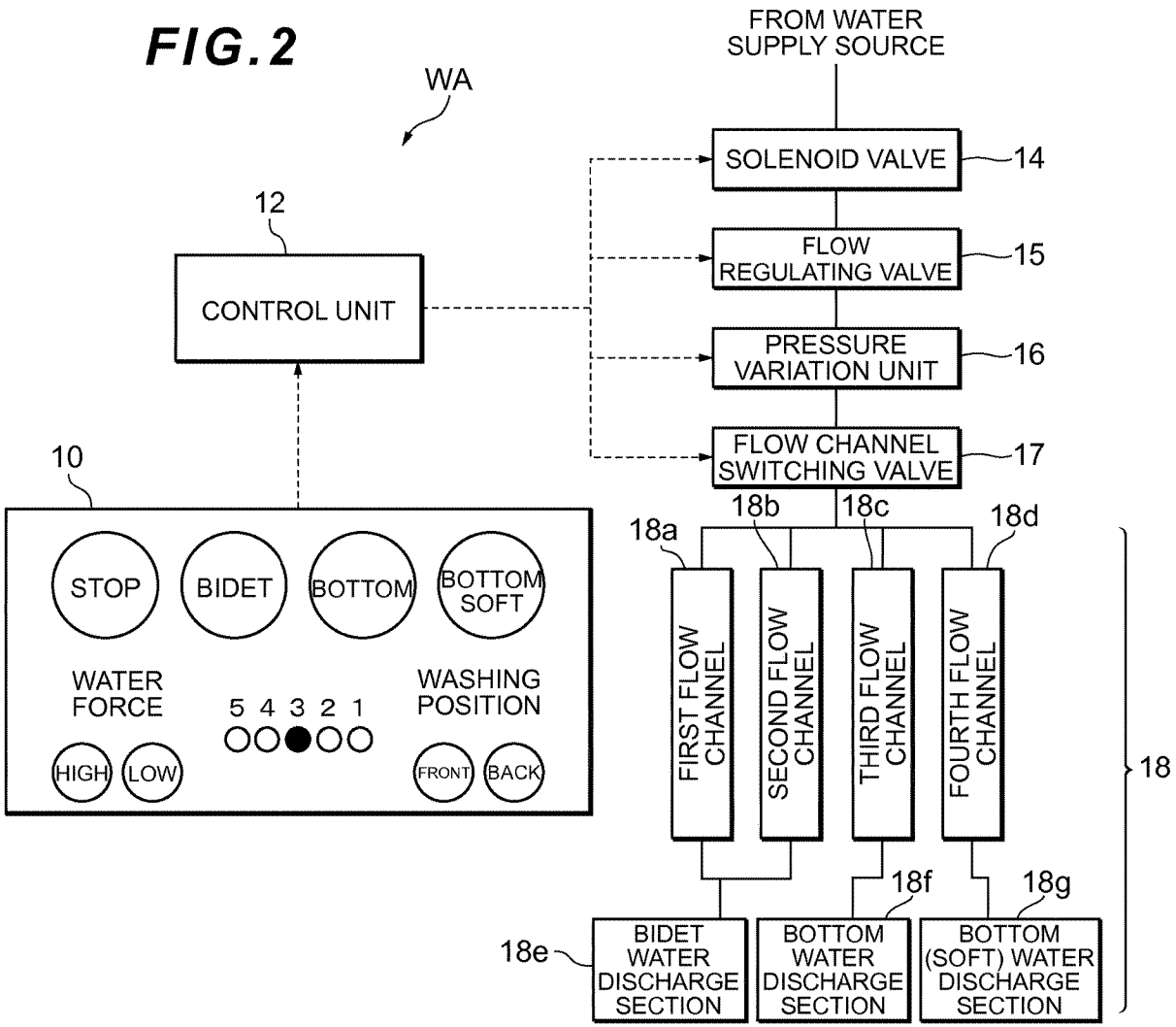
FIG. 2 is a block configuration view illustrating a functional configuration of the sanitary washing apparatus according to the embodiment of the present invention.

Subsequently, a mechanism that switches modes of wash water discharged from the nozzle 18 will be described by reference to FIG. 2. FIG. 2 is a block configuration view illustrating a functional configuration of the warm water washing toilet seat as the sanitary washing apparatus. As shown in FIG. 2, the warm water washing toilet seat WA includes the operation unit 10, a control unit 12, a solenoid valve 14, a flow regulating valve 15, a pressure variation unit 16, a flow channel switching valve 17, and the wash water supply unit 18 including the nozzle (a bubble mixed water generation unit, an air mixture amount adjustment means). In FIG. 2, when respective blocks are connected by a dashed line, it is indicated that signals are transmitted and received therebetween, and when respective blocks are connected by a solid line, it is indicated that water flows therebetween.

The operation unit 10 is a portion that receives an operation from the user, and transmits an operation signal corresponding to the operation to the control unit 12 when a bidet washing function or a bottom washing function is executed. In the present embodiment, "stop", "bidet", "bottom wash", and "bottom wash (soft)" buttons for starting and stopping water discharge from the wash water supply unit 18 are provided. "High" and "low" buttons for adjusting a force of water from the wash water supply unit 18, and lamps of "1", "2", "3", "4", and "5" that are lit according to the "high" and "low" buttons are also provided.

The control unit 12 is a portion that outputs a predetermined action signal to the solenoid valve 14, the flow regulating valve 15, the pressure variation unit 16, and the flow channel switching valve 17 according to the operation signal inputted from the operation unit 10. The control unit 12 includes an arithmetic element such as a CPU, a memory element such as a RAM and a ROM, and an interface that transmits and receives signals.

The solenoid valve 14 is a valve that functions to cause wash water supplied from a water supply source to flow to a downstream side by separating a valve element from a valve seat, and stop the wash water supplied from the water supply source by bringing the valve element into abutment with the valve seat according to the action signal inputted from the control unit 12. The flow regulating valve 15 is a valve that regulates a flow rate of the wash water flowing from the solenoid valve 14.

The pressure variation unit 16 is a portion that varies a pressure of water to be fed into the wash water supply unit 18, to thereby generate pulsation in water discharged from the wash water supply unit 18. To be more specific, the pressure variation unit 16 is provided with a cylinder having a cylindrical space. A piston is provided within the cylinder. An O-ring is fitted to the piston. A space defined by the piston and the cylinder works as a pressurizing chamber. The cylinder is provided with a wash water inlet. A water supply conduit leading from the flow regulating valve 15 is connected to the wash water inlet such that water is allowed to flow into the pressurizing chamber. An umbrella packing is provided at the wash water inlet so as to prevent a reverse flow to the water supply conduit. The cylinder is also provided with a wash water outlet. The wash water outlet is connected to a water supply conduit leading to the flow channel switching valve 17 such that water pressurized in the cylinder is sent out to the water supply conduit.

When a motor of the pressure variation unit 16 is energized under an instruction from the control unit 12, a rotating shaft rotates, and the piston vertically reciprocates. That is, the piston repeatedly moves to a top dead center from a bottom dead center to perform an action of pressurizing water and pushing the water toward the water supply conduit, and returns to the bottom dead center from the top dead center to perform an action of causing water to flow into the cylinder. Accordingly, a periodic pressure variation, that is, the pulsation is generated in the wash water supplied to the water supply conduit.

The pressure variation unit 16 is configured to intermittently execute a pressure raising process in which a pressure of the wash water discharged from a water discharge port is continuously raised over a predetermined duration such that a mass of water formed with wash water discharged from the water discharge port later catching up with wash water discharged from the water discharge port first intermittently arrives at the private part of the user.

The wash water flowing from the pressure variation unit 16 flows into the flow channel switching valve 17. The flow channel switching valve 17 supplies the wash water to any of a first flow channel 18*a*, a second flow channel 18*b*, a third flow channel 18*c*, and a fourth flow channel 18*d* described below.

The wash water supply unit 18 is a portion that discharges the wash water flowing to a downstream side from the flow channel switching valve 17 from the bidet wash water discharge hole 181 (the water discharge hole) and the bottom wash water discharge hole 182 (the water discharge hole). The wash water supply unit 18 includes the first flow channel 18*a*, the second flow channel 18*b*, the third flow channel 18*c*, the fourth flow channel 18*d*, a bidet water discharge section 18*e*, a bottom water discharge section 18*f*, and a bottom (soft) water discharge section 18*g*.

The first flow channel 18*a* and the second flow channel 18*b* are connected to the bidet water discharge section 18*e*. The third flow channel 18*c* is connected to the bottom water discharge section 18*f*. The fourth flow channel 18*d* is connected to the bottom (soft) water discharge section 18*g*.

Figure 3:
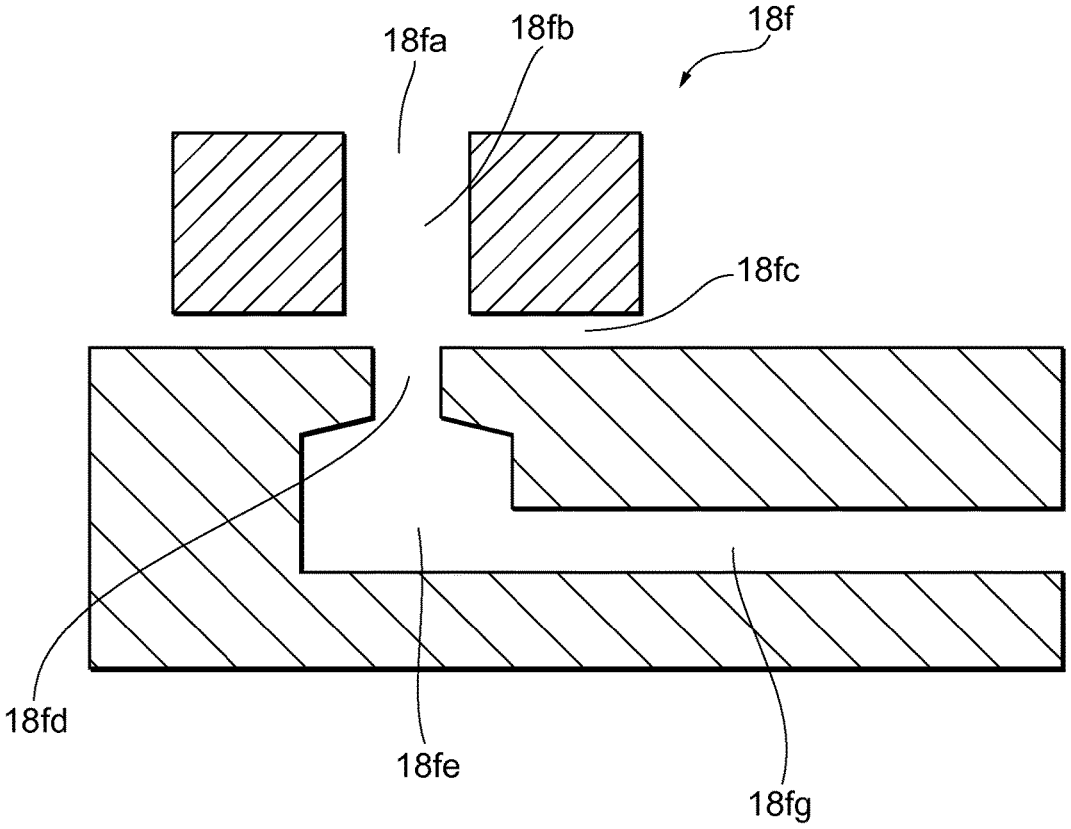
FIG. 3 is a partial sectional view schematically illustrating a configuration of a bottom water discharge section in FIG. 2.

Subsequently, a configuration of the bottom water discharge section 18*f* will be described by reference to FIG. 3. The bottom water discharge section 18*f* has a water discharge port 18*fa*, a bubble mixture section 18*fb*, an air introduction port 18*fc*, a squirting port 18*fd*, a swirl chamber 18*fe*, and a swirl chamber water supply channel 18*fg*.

The squirting port 18*fd* is a portion that squirts the wash water, the pressure of which is varied by the pressure variation unit 16, toward the water discharge port 18*fa*. The air introduction port 18*fc* is a portion that is provided between the squirting port 18*fd* and the water discharge port 18*fa*, and introduces air by use of a negative pressure generated by the wash water squirted from the squirting port 18*fd*.

The bubble mixture section 18*fb* is a portion that is provided between the air introduction port 18*fc* and the water discharge port 18*fa*, temporarily stores the wash water squirted from the squirting port 18*fd*, and mixes the air introduced from the air introduction port 18*fc* into the stored wash water in a form of a plurality of bubbles.

The swirl chamber 18*fe* is a portion that is provided upstream of the squirting port 18*fd*, has a cylindrical wall, and gives a swirl component to the wash water squirted from the squirting port 18*fd*. The swirl chamber water supply channel 18*fg* is a portion that is provided upstream of the swirl chamber 18*fe*, and supplies the wash water to the swirl chamber 18*fe*, and an inner wall on one widthwise side of which is connected to the cylindrical wall along a tangential direction of the cylindrical wall.

Figure 4:
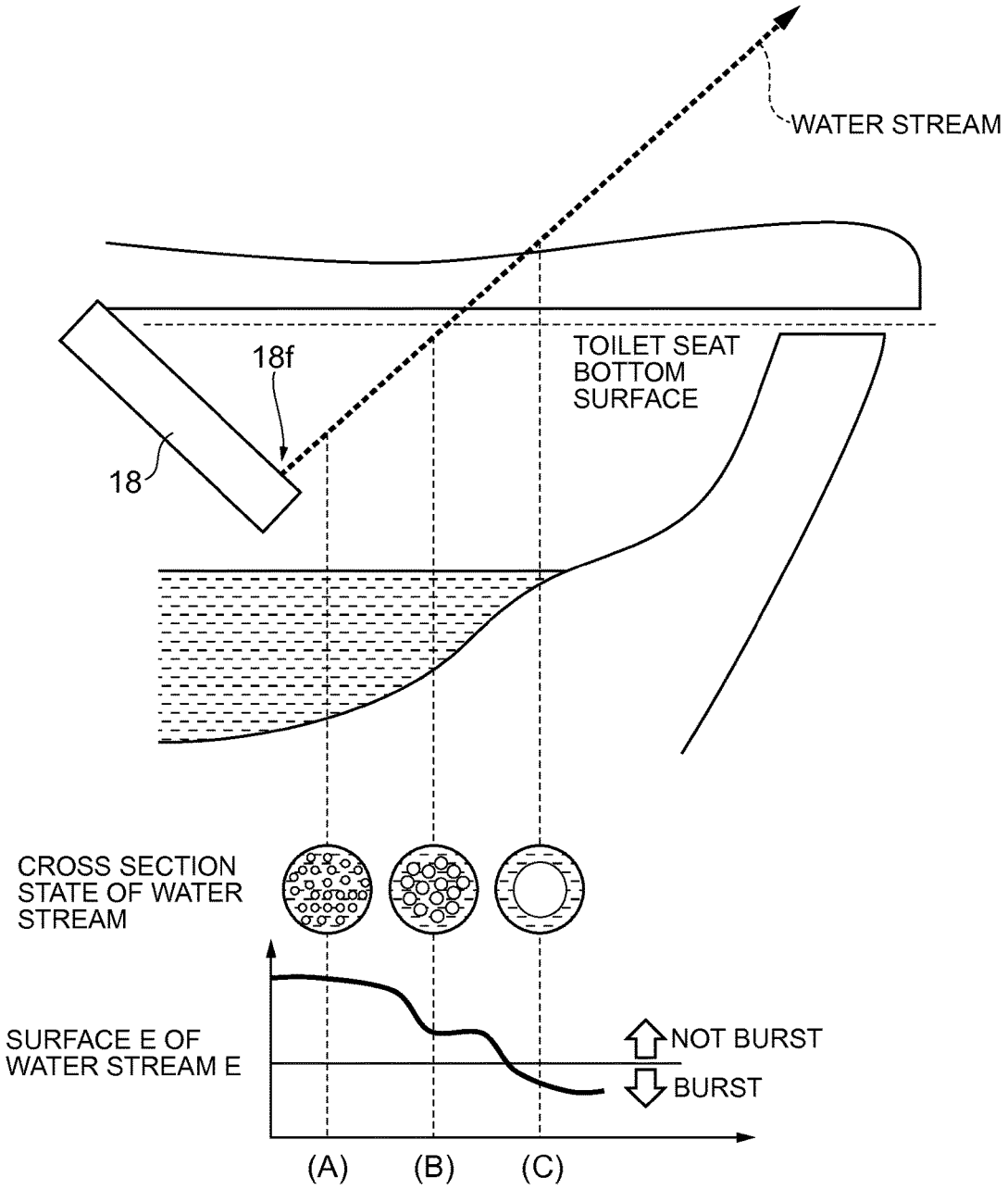
FIG. 4 is a view schematically illustrating a state of wash water discharged from a wash water supply unit (a nozzle)

FIG. 4 is a view schematically illustrating a state of the wash water discharged from the wash water supply unit (the nozzle) 18. As shown in FIG. 4, the wash water supply unit 18 causes the wash water to contain a plurality of bubbles, and also causes the wash water to reach a height corresponding to a bottom surface of the toilet seat before the plurality of bubbles collect into a single bubble. Accordingly, it is possible to cause the wash water to arrive at the user while keeping a state in which the plurality of bubbles are mixed, and to achieve both of a feeling of massiveness felt by the user, and a water saving effect.

In (A) of FIG. 4, a water stream is in a state in which many small bubbles are mixed therein as viewed in cross section, so that the water stream has large surface energy and is unlikely to burst. In (B) of FIG. 4, the water stream is in an interface sharing state that is a state immediately before a water membrane between the small bubbles disappears with the small bubbles collecting to some extent. In the present embodiment, the water stream reaches the height corresponding to the bottom surface of the toilet seat in the state of (B). In (C) of FIG. 4, the water stream is in a state in which the small bubbles collect into one bubble, assuming that the water stream keeps traveling. In actual use, the water stream hits the private part of the user before entering the state of (C).

To be more specific, as shown in FIG. 5, a first water stream containing a small number of micro bubbles and having a low flow velocity, and a second water stream containing a large number of micro bubbles and having a high flow velocity are alternately squirted (see FIG. 5A). At a point of time when the first water stream reaches the bottom surface of the toilet seat, the second water stream discharged later catches up with the first water stream discharged first, and forms a large mass of water containing many micro bubbles (see FIG. 5C).

As shown in FIG. 6A, the water stream contains micro bubbles in a state in which the micro bubbles are apart from each other. After that, the water stream is torn and assumes a state in which the micro bubbles come into contact with each other and share an interface as shown in FIG. 6B. In the gas-liquid interface sharing state in which the bubbles share the interface as described above, the number of gas-liquid interfaces is slightly decreased, so that the mass of water can be softened without being destroyed. It is thus possible to relieve stimulation of discharged water while increasing a water discharge pressure and forming a larger mass of water.

Figure 7:
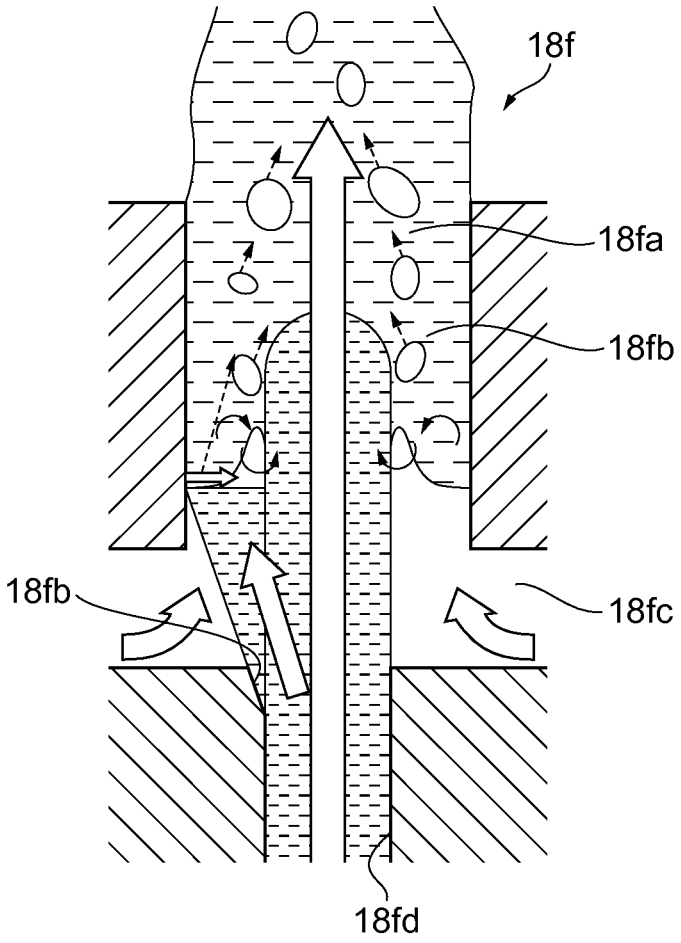
FIG. 7 is a view schematically illustrating a state of the wash water discharged from the wash water supply unit (the nozzle)

The wash water supply unit 18 mixes bubbles by using an ejector effect. FIG. 7 shows a bubble mixture state in the bottom water discharge section 18*f* of the wash water supply unit 18. As shown in FIG. 7, in the bottom water discharge section 18*f*, the air introduction port 18*fc* is provided between the squirting port 18*fd* and the water discharge port 18*fa*. The bubble mixture section 18*fb* is provided between the air introduction port 18*fc* and the water discharge port 18*fa*.

A flow channel diameter of the bubble mixture section 18*fb* is formed to be larger than a flow channel diameter of the squirting port 18*fd*. Water squirted from the squirting port 18*fd* reaches the bubble mixture section 18*fb*. The water reaching the bubble mixture section 18*fb* is temporarily stored in the bubble mixture section 18*fb*, and water squirted later breaks into the stored water. The water squirted from the squirting port 18*fd* breaks into the stored water while entraining air from the air introduction port 18*fc*, so that bubble mixed water is formed in the bubble mixture section 18*fb*, and is squirted outside.

An orientation inclined portion 18*fh* is formed in the squirting port 18*fd*. Therefore, the water squirted from the squirting port 18*fd* is oriented so as to hit a portion of a side surface of the bubble mixture section 18*fb*. Since the wash water is temporarily stored in the vicinity of the water discharge hole, and air is mixed into the stored wash water by the ejector effect as described above, it is possible to achieve both of prevention of the collection of bubbles with too many bubbles being mixed, and a size increase of the mass of water by increasing the water discharge pressure and increasing the catching-up water stream.

Also, a bubble mixture amount is reduced by causing the water to hit a portion of the side surface of the bubble mixture section 18*fb* to decrease a water amount, and thereby reducing a thickness of a water membrane formed by the water hitting the side surface of the bubble mixture section 18*fb* rather than adjustment using a strength of the water stream.

As described above, in the present embodiment, an amount of air mixed in the bubble mixture section 18*fb* is adjusted such that the wash water reaches the height corresponding to the bottom surface of the toilet seat before the plurality of bubbles mixed in the bubble mixture section 18*fb* collect into a single bubble. Therefore, the respective portions of the wash water supply unit 18 interact with each other to constitute the air mixture amount adjustment means of the present invention.

In the present embodiment, it is configured that the amount of air mixed in the bubble mixture section 18*fb* is made larger at the time of a maximum pressure than at the time of a minimum pressure in the pressure raising process. A water stream having a high water discharge pressure has a high flow velocity, and it takes shorter to reach a height position (see FIG. 4) corresponding to the bottom surface of the toilet seat from the bubble mixture section 18*fb*. Thus, even when much air is mixed into the water stream having a high water discharge pressure, the bubbles do not fully collect before the water stream reaches the height position. It is thus possible to prevent the water stream from bursting before the water stream reaches the private part of the user while improving the feeling of massiveness by mixing much air into the water stream having a high water discharge pressure.

In the present embodiment, it is configured that the amount of air mixed in the bubble mixture section 18*fb* is adjusted such that the gas-liquid interface sharing state that is the state immediately before the water membrane between the plurality of bubbles disappears with the plurality of bubbles adjoining each other is formed in the wash water discharged from the water discharge port 18*fa* at the height corresponding to the bottom surface of the toilet seat (see FIG. 4). Since the gas-liquid interface sharing state that is the state immediately before the water membrane between the plurality of bubbles disappears with the plurality of bubbles adjoining each other is formed in the wash water at the height corresponding to the bottom surface of the toilet seat, it is possible to cause the wash water to arrive at the private part in a state in which the wash water is slightly easily deformed, and thereby prevent a feeling of stimulation from becoming too strong.

In the present embodiment, it is configured that the wash water discharged later completely catches up with the wash water discharged first in the pressure raising process immediately before the wash water discharged from the water discharge port 18*fa* reaches the height corresponding to the bottom surface of the toilet seat, and the mass of water is torn from the water stream continuing from the water discharge port (see FIG. 5). Since the catch-up phenomenon is completed immediately before the wash water reaches the height corresponding to the bottom surface of the toilet seat, the wash water arrives before a bubble stirring action is generated by the catch-up phenomenon, so that the gas-liquid interface sharing state can be more surely formed.

In the present embodiment, it is configured that the wash water temporarily stored in the bubble mixture section 18*fb* is formed by causing only a portion of a periphery of the wash water squirted from the squirting port 18*fd* to interfere (see FIG. 7).

Since the wash water temporarily stored in the bubble mixture section 18*fb* is formed by causing only a portion of the periphery of the wash water squirted from the squirting port 18*fd* to interfere, the amount of the wash water temporarily stored in the bubble mixture section 18*fb* can be decreased, so that the air mixture amount can be decreased in the present embodiment in which air is mixed by the ejector effect. By decreasing the air mixture amount, even when air is mixed by the ejector effect into discharged water to which pressure variation in a high-pressure band is given, a small amount of bubbles having a relatively small size can be introduced. It is thus possible to cause the wash water to reach the height corresponding to the bottom surface of the toilet seat before the plurality of bubbles mixed in the bubble mixture section 18*fb* collect into a single bubble.

In the present embodiment, the squirting port 18*fd* is formed such that a spread angle of the wash water squirted from the squirting port 18*fd* with respect to a center axis of the squirting port 18*fd* has a first angle (an angle toward a left side in FIG. 7) and a second angle (an angle toward a right side in FIG. 7) smaller than the first angle.

If the spread angle is made uniform, it is necessary to design the flow channel in consideration of the spread angle of the wash water and a dimensional tolerance on a side where the periphery of the wash water squirted from the squirting port 18*fd* does not interfere in order to cause only a portion of the periphery of the wash water squirted from the squirting port 18*fd* to interfere. Thus, by forming a region in which the spread angle of the wash water is set to the smaller second angle, the dimensional tolerance can be increased without increasing dimensions of the entire flow channel.

Figure 8:
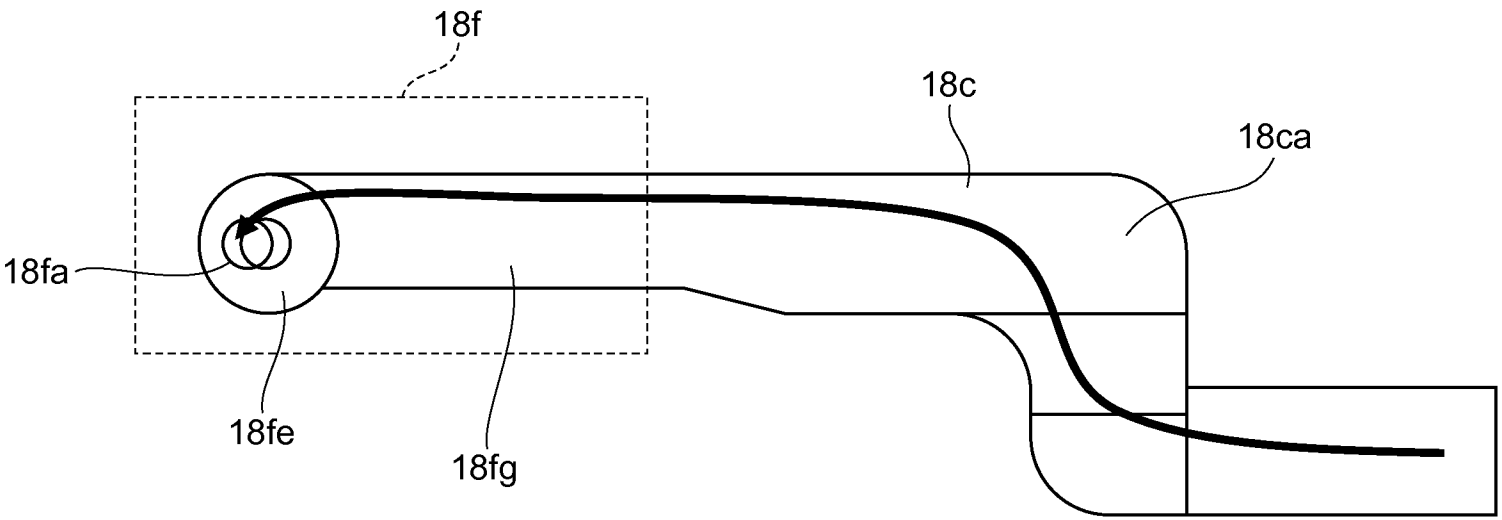
FIG. 8 is a view illustrating a configuration of the bottom water discharge section and a third flow channel in FIG. 2.
Figure 9:
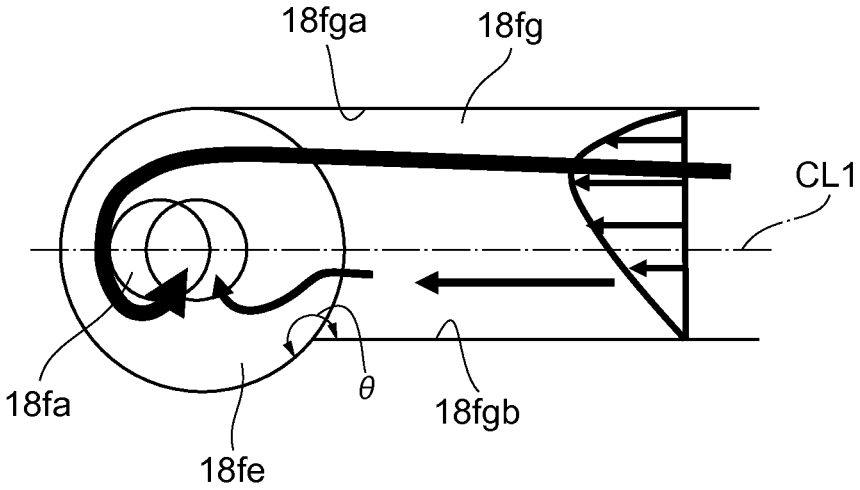
FIG. 9 is an enlarged view illustrating the bottom water discharge section in FIG. 8.
Figure 10:
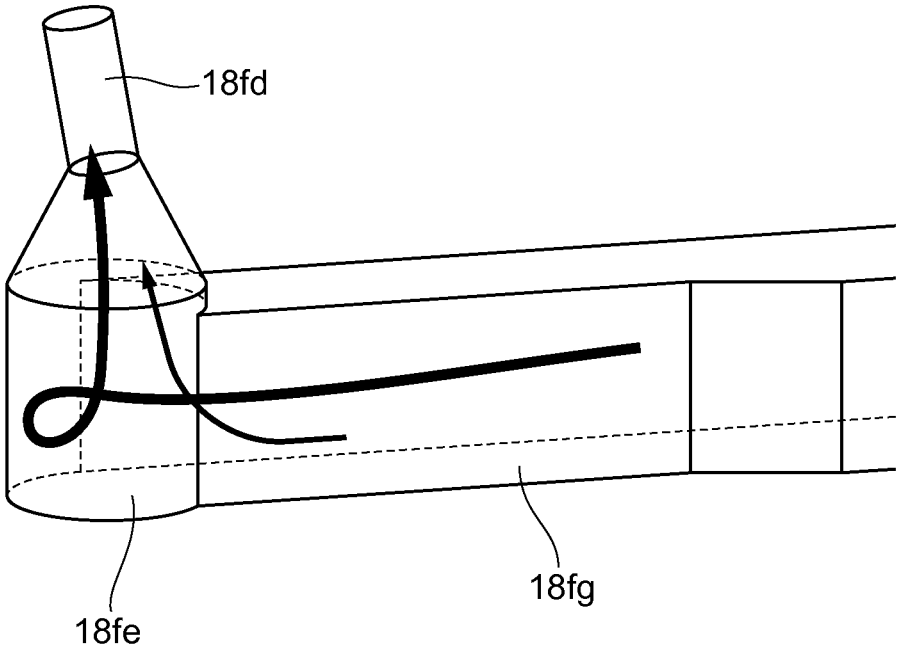
FIG. 10 is a perspective view of the bottom water discharge section in FIG. 8.

In the present embodiment, a width of the swirl chamber water supply channel 18*fg* is formed to be larger than a radius of the swirl chamber 18*fe*. FIG. 8 is a plan view of the bottom water discharge section 18*f* and the third flow channel 18*c*. FIG. 9 is a partial enlarged view of the bottom water discharge section 18*f*. FIG. 10 is a perspective view of the bottom water discharge section 18*f*.

As shown in FIG. 9, the width of the swirl chamber water supply channel 18*fg* is formed to be larger than the radius of the swirl chamber 18*fe*. Since the width of the swirl chamber water supply channel 18*fg* is formed to be larger than the radius of the swirl chamber 18*fe*, a flow channel sectional area of the water supply channel can be increased, and a flow velocity of wash water flowing into the swirl chamber 18*fe* can be reduced. Since the flow velocity of the wash water flowing into the swirl chamber 18*fe* can be reduced, a flow velocity of wash water flowing in the tangential direction (a flow indicated by a thick arrow in FIG. 9) can be also decreased, so that a flow velocity of a swirling flow can be reduced. Also, both of the wash water flowing in the tangential direction and wash water flowing through an opposite portion to the tangential direction have a low flow velocity when flowing into the swirl chamber 18*fe*. Thus, the wash water flowing in the tangential direction and the wash water flowing through the opposite portion do not disturb the swirling flow when joining each other as a flow toward the squirting port 18*fd*.

As shown in FIG. 9, in the present embodiment, a connection angle θ between an inner wall 18*fgb* on the other widthwise side of the swirl chamber water supply channel 18*fg* and the cylindrical wall is configured to be an angle that suppresses generation of a local eddy. The connection angle θ between the inner wall 18*fgb* on the other widthwise side of the swirl chamber water supply channel 18*fg* and the cylindrical wall is configured to be, for example, 180° or more and 270° or less so as to be the angle that suppresses the generation of the local eddy. Thus, the generation of the eddy can be suppressed and the disturbance of the swirling flow can be reduced.

In the present embodiment, a projection that rectifies the swirling flow is not provided in the center of the swirl chamber 18*fe*. Therefore, the swirling flow velocity can be reduced as compared to a case in which a rectifying projection is provided in the center.

As shown in FIGS. 8, 9, and 10, in the present embodiment, a bend portion 18*ca* is provided such that a flow velocity in the vicinity of an inner wall 18*fga* on the one widthwise side is higher than a flow velocity in the vicinity of the inner wall 18*fgb* on the other widthwise side.

Since the bend portion 18*ca* is provided such that the flow velocity on the one widthwise side is higher than the flow velocity on the other widthwise side, wash water having a high flow velocity can be supplied in a direction along the cylindrical wall of the swirl chamber 18*fe*. Thus, the generation of the eddy can be suppressed and the disturbance of the swirling flow can be reduced.

In the present embodiment, when the "bottom" or the like of the operation unit 10 that is a water discharge start operation section is operated, the control unit 12 executes, before executing a main washing mode in which wash water is discharged at a set flow rate selected by the "water force" of the operation unit 10 that is a water force selection operation section, a stored water generating mode in which required wash water is stored in the bubble mixture section 18*fb* by discharging wash water at a set flow rate smaller than the flow rate selected in the water force selection operation section. To be more specific, for example, when a set water force in the main washing mode is "5", a set water force in the stored water generating mode is "3" as shown in FIG. 11.

In the present embodiment, since the stored water generating mode in which wash water is discharged at a flow rate smaller than a set flow rate selected by the user is provided before the main washing mode as described above, a small amount of wash water can be stored in the bubble mixture section. Accordingly, the air mixture amount mixed into the wash water can be decreased. Thus, even when air is mixed into the discharged water to which the pressure variation in the high-pressure band is given, it is possible to suppress the burst of the water stream before the water stream reaches the private part of the user.

Figure 12:
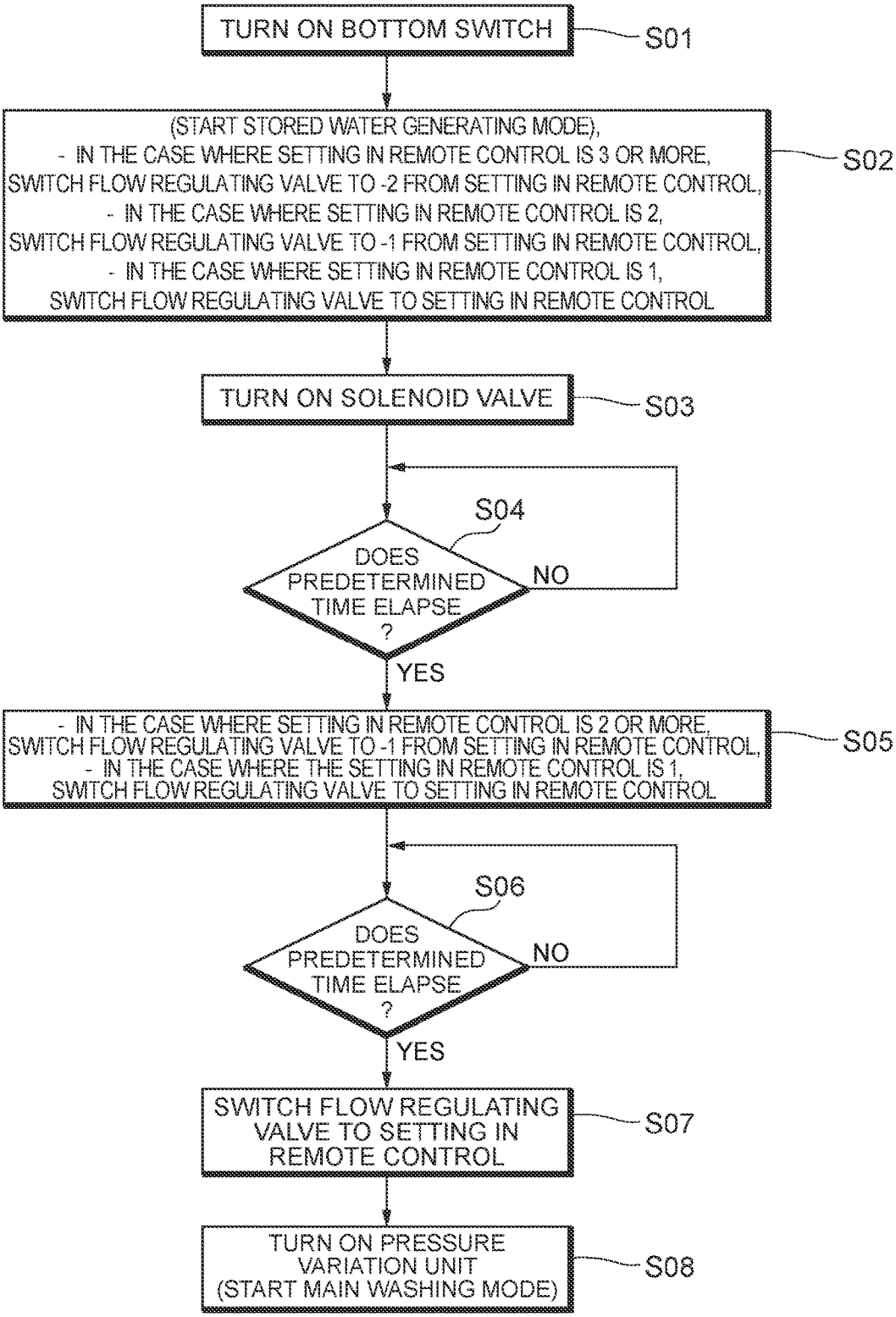
FIG. 12 is a flowchart illustrating an action of a control unit in FIG. 2.

A specific action of the control unit 12 will be described by reference to a flowchart in FIG. 12. In step S01, the "bottom" switch of the operation unit 10 shown in FIG. 2 is turned ON by the user.

In step S02 subsequent to step S01, the stored water generating mode is started. The control unit 12 outputs a control signal for discharging wash water with a water force two levels lower than a water force setting value of the operation unit 10 to the flow regulating valve 15. The control unit 12 outputs a control signal for switching the flow channel to the third flow channel 18*c* to the flow channel switching valve 17.

In step S03 subsequent to step S02, the control unit 12 outputs a valve open signal to the solenoid valve 14. In step S04 subsequent to step S03, the control unit 12 determines whether a predetermined time has elapsed. When the predetermined time has not elapsed, the control unit 12 repeats the determination. When the predetermined time has elapsed, the control unit 12 proceeds to step S05.

In step S05, the control unit 12 outputs a control signal for discharging wash water with a water force one level lower than the water force setting value of the operation unit 10 to the flow regulating valve 15. In step S06 subsequent to step S05, the control unit 12 determines whether a predetermined time has elapsed. When the predetermined time has not elapsed, the control unit 12 repeats the determination. When the predetermined time has elapsed, the control unit 12 proceeds to step S07.

In step S07, the control unit 12 outputs a control signal for discharging wash water with a water force corresponding to the water force setting value of the operation unit 10 to the flow regulating valve 15. In step S08 subsequent to step S07, the control unit 12 outputs a control signal for driving the pressure variation unit 16, and the main washing mode is started.

In the present embodiment, the control unit 12 suppresses operation of the pressure variation unit 16 in the stored water generating mode to be lower than operation of the pressure variation unit 16 in the main washing mode.

By suppressing the operation of the pressure variation unit 16 in the stored water generating mode to be lower than the operation of the pressure variation unit 16 in the main washing mode, it is possible to surely store a small amount of wash water in the bubble mixture section 18*fb* in the stored water generating mode.

As shown in FIG. 11, in the present embodiment, the control unit 12 is configured to increase the flow rate of the wash water discharged in the stored water generating mode according to an increase in the flow rate (corresponding to the water force in the main washing mode) selected in the water force selection operation section.

When the flow rate in the main washing mode is increased, a force for pushing out the stored wash water is also increased. In order to respond to the pushing force, the flow rate in the stored water generating mode is increased to increase the stored water according to the increase in the flow rate in the main washing mode such that the stored wash water is not pushed outside all at once by a squirting force.

As described by reference to FIG. 12, in the present embodiment, the control unit 12 executes a gradual transition mode (step S05 and step S06 in FIG. 12) in which the flow rate is gradually made closer to the flow rate in the main washing mode from the flow rate in the stored water generating mode between the stored water generating mode and the main washing mode.

By executing the gradual transition mode in which the flow rate is gradually made closer to the flow rate in the main washing mode from the flow rate in the stored water generating mode as described above, the user feels less uncomfortable about a change in the flow rate from the stored water generating mode to the main washing mode.

As described by reference to FIG. 12, after the gradual transition mode is completed, the control unit 12 starts operating the pressure variation unit. Accordingly, the user feels less uncomfortable about a change in the flow rate from the stored water generating mode to the main washing mode.

Figure 13:
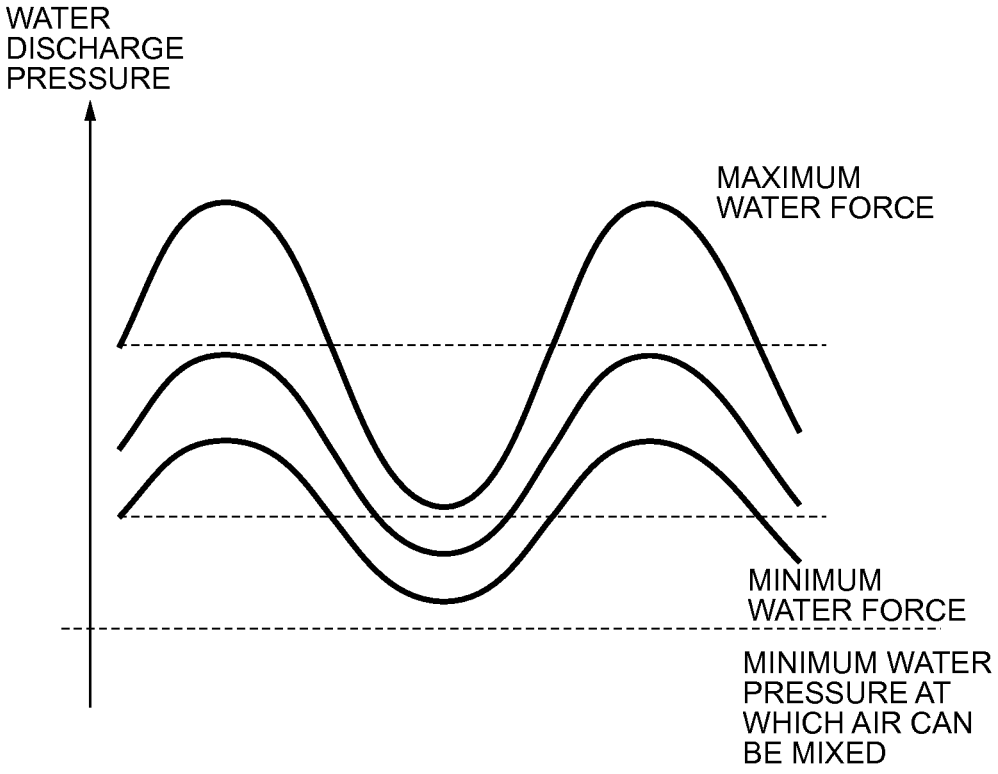
FIG. 13 is a view illustrating pressure variation given to wash water by a pressure variation unit in FIG. 2.

The pressure variation unit 16 in the present embodiment is configured to mix a predetermined amount or more of air in a minimum pressure state in all the water forces. In the present embodiment, air is introduced by use of the negative pressure generated by the wash water squirted from the squirting port 18*fd*, the wash water squirted from the squirting port 18*fd* is temporarily stored, and the air introduced from the air introduction port 18*fc* is mixed into the stored wash water in the form of the plurality of bubbles. Thus, bubble mixed water can be generated without using an air pump or the like. In the present embodiment, as shown in FIG. 13, a predetermined amount or more of air (a minimum water pressure at which air can be mixed) is mixed in the minimum pressure state in all the water forces. Thus, eve when air is mixed into the discharged water to which the pressure variation is given, it is possible to suppress the burst of the water stream when the catch-up phenomenon occurs.

As shown in FIG. 13, in the present embodiment, the pressure variation unit 16 is configured to increase the minimum pressure according to an increase in the water force. As the water force is increased, the maximum pressure is increased. Thus, the air mixture amount at this time is increased, and the catching-up water stream becomes harder. By increasing the minimum pressure according to the increase in the water force, the air mixture amount of the water stream on the caught-up side is increased according to the hardness of the water stream on the catching-up side. As a result, it is possible to more surely prevent the water stream from bursting in the occurrence of the catch-up phenomenon in all the water forces.

What is claimed is:

1. A sanitary washing apparatus that discharges wash water toward a private part of a user, the sanitary washing apparatus comprising:

a toilet seat on which the user sits for excretion;

a washing nozzle having a water discharge port that discharges the wash water toward the private part of the user sitting on the toilet seat;

a pressure variation unit that gives pressure variation to the wash water to be supplied to the water discharge port;

a bubble mixed water generation unit that is provided between the pressure variation unit and the water discharge port to mix bubbles into the wash water to which the pressure variation is given by the pressure variation unit;

an operation unit having a water discharge start operation section that allows the user to instruct a water discharge start of the wash water, and a water force selection operation section that allows the user to select a set flow rate of the wash water; and a controller that controls the sanitary washing apparatus according to an input to the operation unit, wherein the pressure variation unit intermittently executes a pressure raising process in which a pressure of the wash water discharged from the water discharge port is continuously raised over a predetermined duration, the bubble mixed water generation unit includes:

a squirting port that squirts the wash water to which the pressure variation is given by the pressure variation unit toward the water discharge port;

an air introduction port that is provided between the squirting port and the water discharge port to introduce air by use of a negative pressure generated by the wash water squirted from the squirting port; and a bubble mixture section that is provided between the air introduction port and the water discharge port to temporarily store the wash water squirted from the squirting port and mix the air introduced from the air introduction port into the stored wash water, when the water discharge start operation section is operated, before executing a main washing mode in which wash water is discharged at a set flow rate selected in the water force selection operation section, if the set flow rate selected in the water force selection operation section is not set at a lowest setting, the controller executes a first stored water generating mode, and required wash water is stored in the bubble mixture section by discharging wash water at a set flow rate smaller than the set flow rate selected in the water force selection operation section; and if the set flow rate selected in the water force selection operation section is set at the lowest setting, the controller executes a second stored water generating mode, and required wash water is stored in the bubble mixture section by discharging wash water at the lowest flow rate equivalent to the set flow rate selected in the water force selection operation section.

2. The sanitary washing apparatus according to claim 1, wherein the controller is configured to increase the flow rate of the wash water discharged in the first or second stored water generating mode according to an increase in the flow rate selected in the water force selection operation section.

3. The sanitary washing apparatus according to claim 1, wherein the controller executes a gradual transition mode in which the flow rate is gradually made closer to the flow rate in the main washing mode from the flow rate in the first or second stored water generating mode between the first or second stored water generating mode and the main washing mode.

4. The sanitary washing apparatus according to claim 3, wherein after the gradual transition mode is completed, the controller starts operating the pressure variation unit.

* * * * *